United States Patent [19]

Huang et al.

[11] 3,971,878

[45] July 27, 1976

[54] VLF ANTENNA TOWER BASE INSULATOR

[75] Inventors: Kwang Ta Huang, Port Hueneme; James L. Brooks, Oxnard, both of Calif.

[73] Assignee: The United States of America as represented by the Secretary of the Navy, Washington, D.C.

[22] Filed: Oct. 3, 1975

[21] Appl. No.: 619,556

[52] U.S. Cl. ..... 174/30; 343/874

[51] Int. Cl.[2] ..... H01B 17/34

[58] Field of Search ..... 174/15 BH, 30, 138 A; 343/874, 875, 885

[56] References Cited

UNITED STATES PATENTS 2,343,078 2/1944 Peters ..... 343/874

*Primary Examiner*—Eli Lieberman

*Attorney, Agent, or Firm*—Richard S. Sciascia; Joseph M. St.Amand

[57] ABSTRACT

A base insulator design for VLF antennas. A surface insulating material, such as glass, serves to provide a long surface distance between the upper and lower metallic components of the base. A thin, soft metal cover extends the base metal conductor out to the edge of the outer insulator and also provides a weather shield for the internal components. An insulator core of porcelain serves to take up all of the mechanical stress in the structure and a dielectric fluid serves as a coolant which also protects the inside surface from contamination.

10 Claims, 2 Drawing Figures

VLF ANTENNA TOWER BASE INSULATOR

BACKGROUND OF THE INVENTION

This invention relates to insulators and more particularly to very low frequency (VLF) antenna base insulators.

VLF antennas frequently are very tall, narrow structures which rest upon a base insulator on one end and extend vertically well over a thousand feet into the air. They derive their lateral support from guy wires extending out radially and downward from several different heights along the vertical length. The weight of some of these structures has been estimated at about three million pounds. Some such antennas are operated electrically at about 250 KV (rms) at 30 KHz. The base insulator(s) therefore have tremendous mechanical and electrical load requirements, some of which are conflicting.

Some failures have been experienced with prior art type existing base insulators and, because of the costs involved in replacing them, the whole problem associated with acquiring insulators for VLF antennas, including design, manufacture and acceptance testing, must be re-examined.

Existing prior type insulators are made of porcelain cast in bell-shaped units which are then used in clusters of three, and stacked in three tiers. The size of the insulators is limited due to the difficulties associated with casting the material. Normal insulator technology makes use of sheds and petticoat rings which become extremely difficult to cast flawlessly as the size of the insulator increases. As a consequence, existing insulators have been cast smooth so that a large insulator could be cast flawlessly; the lack of sheds and petticoats, however, place a limit on the electrical performance of the insulator. This, in turn, has necessitated stacking insulators in three tiers in order to handle the electrical load which in turn has caused mechanical problems because of the increased length. While porcelain demonstrates a very high compressive strength, it is severely limited in its ability to withstand tensile forces and lateral forces. In addition, the problems associated with minute cracks and flaws, contaminants and humid conditions become compounded at VLF frequencies due to heating in the immediate vicinity of the flaw or contaminant. A detailed analysis of each of the problems associated with these prior type base insulators show that, in all cases, the critical area is the surface of the insulator. Not only does the maximum mechanical stress occur at the surface, but the electrical problems are most acute on the surface, i.e., contamination, field concentration, minute cracks which lead to corona, and flashover. It has been found that the whole philosophy of using only ceramics as the antenna base material needed be re-examined and a new design approach taken.

SUMMARY OF THE INVENTION

A new base insulator, as disclosed herein, is based on the premise that the mechanical and electrical load requirements are too great for one material and therefore need to be handled separately by different materials and configurations which can be chosen to optimize the performance of each. The surface insulating material (glass preferred) of this new insulator is designed to provide a very long surface distance between the upper metallic components and the lower metallic components, and is not required to handle any of the mechanical load. A thin, soft metal cover extends the base metal conductor to the edge of the outer insulator and, at the same time, provides a weather shield for the internal components. An insulator core takes all of the mechanical stresses associated with the structure and the length of this insulator is considerably shorter than the external insulator. Dielectric fluid serves to protect the inside surfaces from contamination and also serves as a coolant.

The base insulator of this invention allows a complete separation of the mechanical requirements and the electric requirements. In prior design, mechanical and electrical requirements were conflicting, particularly at the surface of the insulator. The present design allows two (clusters of three) insulators in two tiers to replace three (clusters of three) in three tiers, as previously required. This is accomplished by eliminating the previously required distance between upper and bottom electrodes. In turn, this eliminates most of the bending moment which an insulator is subjected to. The surface leakage path is greatly extended, thereby greatly reducing corona and flashover problems associated with surface contamination. The temperature of the entire new insulator can be controlled by circulating the dielectric fluid, thereby eliminating hot spots and overheating, which was experienced with the prior type insulators. In addition, the difficulties encountered in manufacturing prior insulators has been avoided with the present insulator design because the stringent and conflicting surface requirements have been separated. The present invention overcomes the disadvantages of prior insulators by providing temperature control, surface contamination control, and electrical field shaping and control.

DETAILED DESCRIPTION OF THE PREFERRED EMBODIMENT

Figure 1:
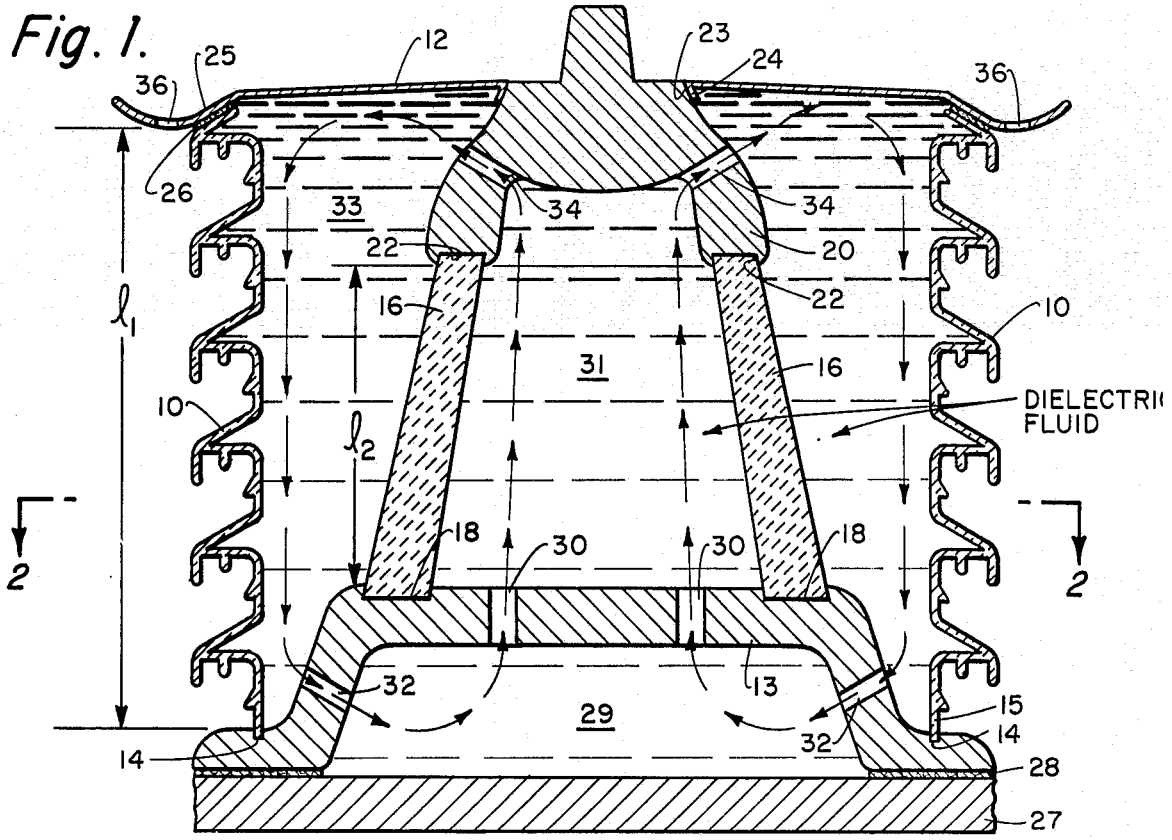
FIG. 1 is an elevational view in cross-section of a preferred embodiment of the invention.
Figure 2:
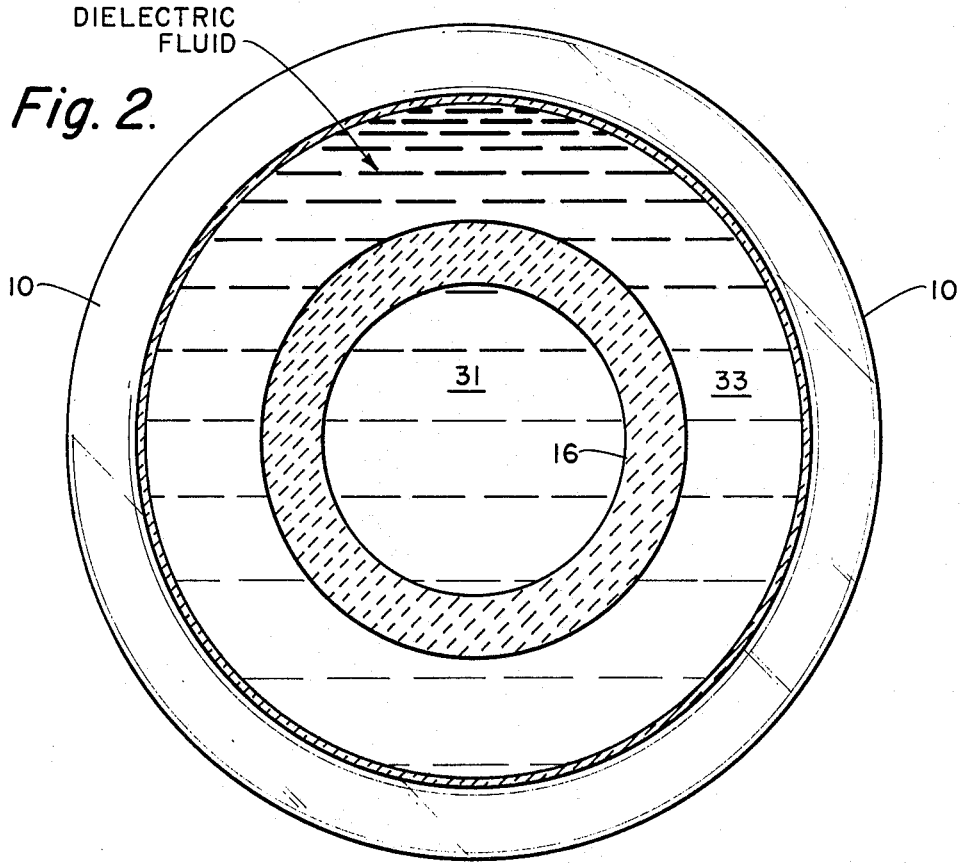
FIG. 2 is a top cross-sectional view of the embodiment shown in FIG. 1 taken along line 2—2.

Since mechanical and electrical load requirements are too great for one material, these requirements are handled separately in this invention using different materials and configurations which optimize the performance of each in a new base insulator designed for VLF antennas. The present invention is illustrated in FIGS. 1 and 2 which show a simplified cross-sectional view of a cylindrical structure. A cylindrical housing 10 of surface insulating material, preferably glass, is designed to provide a very long surface distance between the upper metallic cover 12 and the lower metallic base member 13. The wall of housing 10 is in the form of a plurality of sheds and petticoats, as shown in the vertical cross section of FIG. 1. At the same time, housing 10 does not handle any of the mechanical load. Base member 13 has a groove 14 in the outer flange in which the bottom edge 15 of cylindrical housing 10 is positioned; a sealant material must be used to assure a good seal.

Cover 12, of thin, soft metal such as copper, is designed to extend the metal conductor cover out to slightly beyond the edge of the outer housing insulator 10 and, at the same time, provide a weather shield for the internal components of the device. Being a very thin and soft material cover 12 does not transmit mechanical forces to the outer housing insulator 10. An inner insulator core 16, preferably made from porcelain, is designed to take all of the mechanical stresses associated with the VLF insulator structure. The smooth walls of core 16 eliminate the concentration of mechanical stress at the surface, which is usually associated with the use of sheds and petticoats. Core 16 must also withstand desired electrical stress; however, it readily does this because it is completely immersed in a dielectric liquid which eliminates surface effects. Note that the length $l_2$ of insulator core 16 is considerably shorter than the height $l_1$ of the external housing insulator 10, also favoring mechanical requirements. Core 16 sits in groove 18, provided in the rim of base 13.

A metal cap 20 sits on top of core 16, as illustrated in FIG. 1. A groove 22 securely positions the cap over core 16. Cap 20 also supports cover 12 and positions the cover over housing insulator 10 such that mechanical forces are not transmitted to the housing insulator. The cap may extend through an aperture 23 in the cover, as shown in FIG. 1. The top of cap 20 fits securely within aperture 23 and a small flange 24 engages the edge of aperture 23 to provide a seal about the top of cap 20. The outer flange 25 of cover 12 is contoured to fit about and seal the upper edge 26 of housing insulator 10. A sealant material may be used between flange 25 and edge 26, if desired. Base member 13, when seated on a ground plate or foundation 27 and sealed thereto by a seal 28 about the rim, has a chamber 29 formed thereunder due to its inverted pan shape. Passageways 30 are provided in base member 13 between chamber 29 at the bottom of the VLF insulator structure and space 31 inside of core 16. Additional passageways 32 are provided in the side wall of base member 13 between chamber 29 and space 33 between the outer wall of core 16 and inner wall of housing insulator 10. Cap 20 also has passageways 34 provided therein between the space 31 inside of core 16 and space 33.

Chamber 29 and spaces 31 and 33 are filled with a dielectric fluid, preferably mineral oil, which serves to protect the inside surfaces of the structure and also serves as a coolant. Dielectric fluid is circulated throughout the structure via passages 30, 32 and 34 with the direction of flow indicated by arrows in FIG. 1 due to the natural density differences in the fluid created by heating as a result of the a.c. electrical field. If desired, the dielectric fluid can be circulated at a greater rate by means of external pumping apparatus, not shown. When external pumping apparatus is used, the dielectric fluid can, at the same time, be additionally cooled by pumping the fluid through cooling apparatus, if desired.

Drain holes 36 are provided about the bottom of contoured flange 25 of cover 12 to permit run-off of water from rain or moisture condensation.

The new VLF base insulator disclosed herein allows more design freedom in the choice of materials and structural shapes than heretofore. The structure shown in FIG. 1 illustrates the concept for separating the conflicting mechanical and electrical requirements, and for controlling the critical factors which affect the insulator, such as the surfaces, temperature and environment.

Obviously many modifications and variations of the present invention are possible in light of the above teachings It is therefore to be understood that within the scope of the appended claims the invention may be practiced otherwise than as specifically described herein.

What is claimed is:

1. A VLF antenna base insulator comprising:

a. a metal base member having a raised central portion forming a first chamber, and a flanged rim about the bottom edge thereof;

b. a plate means adjacent the bottom of said base member for sealingly enclosing said first chamber;

c. a hollow central core member of insulating material for providing high mechanical support strength, said central core member being seated on top of the raised central portion of said base member; said base member thus enclosing the bottom of said hollow central core member;

d. a cap member enclosing the top of said hollow central core member, thus enclosing a second chamber formed by the inner wall of said hollow core member, said base member and said cap member;

e. a cylindrical housing of surface insulating material comprising a plurality of sheds and petticoats which form the outer insulator wall of the VLF antenna base insulator; the outer surface distance along the longitudinal axis of said cylindrical housing being very long as compared to the axial length thereof;

f. the bottom edge of said cylindrical housing being sealed against the flanged rim of said base member;

g. a metal cover sealingly engaging the top of said cap member and the upper edge of said cylindrical housing, thus enclosing a third chamber formed by the inner wall of said cylindrical housing, the outer wall of said hollow central core member, said base member, said cap member and said cover;

h. mechanical bearing forces and stresses exerted axially on said VLF antenna base insulator assembly being borne by said base member, central hollow core member and cap member, without any such mechanical forces being transmitted to said cylindrical housing;

i. at least one passageway between each of said first and second chambers, said first and third chambers, and said second and third chambers;

j. said first, second and third chambers and said passageways being filled with a dielectric fluid, said dielectric fluid which also acts as a coolant being circulated through said first, second and third chambers via said passageways due to the natural density differences in the fluid as caused by heat generated thereabout by normal a.c. electrical fields formed while the VLF antenna is in use.

2. An insulator structure as in claim 1 wherein said hollow central core member is of porcelain material.

3. An insulator structure as in claim 1 wherein said cap member is metal.

4. An insulator structure as in claim 1 wherein said cylindrical housing is made of glass.

5. An insulator structure as in claim 1 wherein said hollow central core member is in the form of a truncated cone.

6. An insulator structure as in claim 1 wherein said dielectric fluid is mineral oil.

7. An insulator structure as in claim 1 wherein said cover extends beyond the outer edge of said cylindrical housing.

8. An insulator structure as in claim 1 wherein the axial length of said cylindrical housing is considerably greater than the axial length of said hollow central core member.

9. An insulator structure as in claim 1 wherein dielectric fluid is force circulated through said chambers and passageways.

10. An insulator structure as in claim 1 wherein a top portion of said cap member extends through and sealingly engages a central aperture in said metal cover.

* * * * *